US005767434A

United States Patent [19]

Hirtl et al.

[11] Patent Number: 5,767,434

[45] Date of Patent: Jun. 16, 1998

[54] EXPLOSIVE POWDER CHARGE OPERATED SETTING TOOL

[75] Inventors: Anton Hirtl, Gams, Switzerland; Markus Sprenger, Eschen, Liechtenstein

[73] Assignee: Hilti Aktiengesellschaft, Schaan, Liechtenstein

[21] Appl. No.: 762,174

[22] Filed: Dec. 9, 1996

[30] Foreign Application Priority Data

Dec. 21, 1995 [DE] Germany ..... 195 47 859.2

[51] Int. Cl.[6] ..... B25C 1/14

[52] U.S. Cl. ..... 89/1.14; 227/10

[58] Field of Search ..... 89/1.14; 227/10; 42/1.12; 60/638; 173/212

[56] References Cited

U.S. PATENT DOCUMENTS

| | | | |
|---|---|---|---|
| 3,112,487 | 12/1963 | Hilti | 227/10 |
| 3,645,091 | 2/1972 | Ivanov et al. | 227/10 |
| 3,744,240 | 7/1973 | Henning et al. . | |
| 4,655,380 | 4/1987 | Haytayan | 227/9 |
| 4,711,385 | 12/1987 | Jochum | 227/10 |
| 5,170,922 | 12/1992 | Ehmig et al. | 227/8 |
| 5,538,172 | 7/1996 | Jochum et al. | 227/10 |

FOREIGN PATENT DOCUMENTS

| | | | |
|---|---|---|---|
| 223740 | 11/1986 | European Pat. Off. . | |
| 467835 | 7/1991 | European Pat. Off. . | |
| 8025246 | 1/1996 | European Pat. Off. . | |
| 266612 | 3/1970 | U.S.S.R. | 42/1.12 |
| 2171351 | 8/1986 | United Kingdom . | |

*Primary Examiner*—Michael J. Carone
*Assistant Examiner*—Christopher K. Montgomery
*Attorney, Agent, or Firm*—Anderson, Kill & Olick, P.C.

[57] ABSTRACT

An explosive powder charge operated setting tool includes a housing (1), a piston guide (13) for a driving piston (9) located in the housing. The driving piston (9) can be propelled from an initial rearward position through a bore (18) in the piston guide (13) into a forward driving position by gases generated from an ignited cartridge charge (12) in a cartridge chamber (10) located rearwardly of the initial rearward position of the driving piston. A channel (**18*a*, 18*b*) is located in the housing in flow communication with the cartridge chamber and communicating with the guide bore (8) in the piston guide (13). A check valve (5) is positioned in the channel (18*a*, 18*b*) and forms a storage space closed to the ambient atmosphere and made up of a section (18*a*) of the channel (18*a*, 18*b*) closer to the forward driving position of the driving piston and of the guide bore (8). The check valve (5**) can be closed by the gas in the storage space.

3 Claims, 2 Drawing Sheets

EXPLOSIVE POWDER CHARGE OPERATED SETTING TOOL

BACKGROUND OF THE INVENTION

The present invention is directed to an explosive powder charge operated setting tool with a piston guide located in a receiving section of a housing part. The piston guide has an axially extending guide bore for a driving piston which can be propelled from an initial rearward position into a forward setting position by propellant gases generated by an explosive powder charge cartridge. A channel is formed between the receiving section in the housing part and the piston guide and is connected with a cartridge chamber in a rearward part of the housing part and the channel is connected forward in the driving direction through an opening in the piston guide into the guide bore. An opening in the receiving section of the housing part is connected to the ambient atmosphere. A valve arrangement, located in the channel, serves for forming a storage space closed to the ambient atmosphere and located in the region of the channel closer to the forward setting position of the driving piston and also in the guide bore.

An explosive powder charge operated setting tool is disclosed in DE-OS 43 13 504 and includes a housing part, a piston guide, displaceable relative to a receiving section in the housing part, forms a guide bore for a driving piston and a channel connected with a cartridge chamber. The channel is formed by the piston guide and the receiving section in the housing part surrounding the piston guide and spaced radially outwardly from it. The channel is connected with the guide bore through an opening in the piston guide. A valve arrangement is located in the channel adjacent the region of a cartridge chamber and serves for forming a storage space closed to the atmosphere where the storage space is located in the channel and in the guide bore closer to the setting end region of the tool. The valve arrangement is formed by widening the diameter of the piston guide and by a cross-sectional constriction of the receiving section of the housing part within the channel. The channel is closed or opened due to relative displacement of the piston guide with respect to the receiving section of the housing part. To close the channel, the piston guide is displaced in the driving direction relative to the receiving section in the housing part. The volume of the channel and of the storage space is increased, whereby the pressure of the compressed propelling gases is reduced. The driving piston can only be returned at a low speed into its initial position, due to the reduced propelling gas pressure in the storage space. Particularly in the case of a rapid setting sequence of the fastening elements, there is the danger that a subsequent setting step is initiated before the driving piston is returned to its initial position.

SUMMARY OF THE INVENTION

Therefore, the primary object of the present invention is to provide an explosive powder charge operated setting tool of a simple construction and one that is not prone to malfunction and affords a driving piston return using the propelling gases with the piston return function assuring a secure quick return of the driving piston into its initial position, especially in the case of rapid setting sequence.

In accordance with the present invention, the piston guide has a passage adjacent to the cartridge chamber region which is closable by the driving piston and is connected to an opening, and the valve arrangement is formed as a check valve held in the closed position by the influence of propelling gases in the storage space.

The use of a check valve closed by the propellant gases in the storage space enables the formation of a channel and of a storage space having a constant volume. The propelling gas pressure built up in the storage space remains constant when the channel is closed. If the driving piston is accelerated in the setting direction, it opens the passage. The residual propelling gases located in the region closer to the cartridge chamber of the guide bore and/or of the housing part can escape to the atmosphere through the passage and the opening.

Preferably, the check valve is moved into an open position by the propelling gases flowing from the cartridge chamber against the force of a spring. If the gas pressure of the propelling gases flowing out of the cartridge chamber is lower than the pressure of the propelling gases located in the storage space plus the force of the spring, a rapid closing of the channel is achieved by the spring. For instance, the spring acts on a piston which is displaced into an open position by the propelling gases flowing from the cartridge chamber.

Propelling gases are generated when an explosive powder charge cartridge is ignited in the cartridge chamber. In addition to the propelling gases, soot particles and small quantities of unburned powder accumulate, in particular on the surfaces in direct contact with the propelling gases. Such deposits can cause functional difficulties in the operation of the setting tool. For instance, deposits can occur in the region of the piston in the check valve, so that the piston no longer satisfactorily closes the channel and the storage space. Therefore, it is necessary from time to time to clean or replace the parts of the setting tool subject to heavy deposits. So that effective removal and replacement of the check valve of the present invention can be carried out simply and rapidly, it is expedient to locate the check valve in the region of the receiving section of the housing part surrounding the piston guide.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
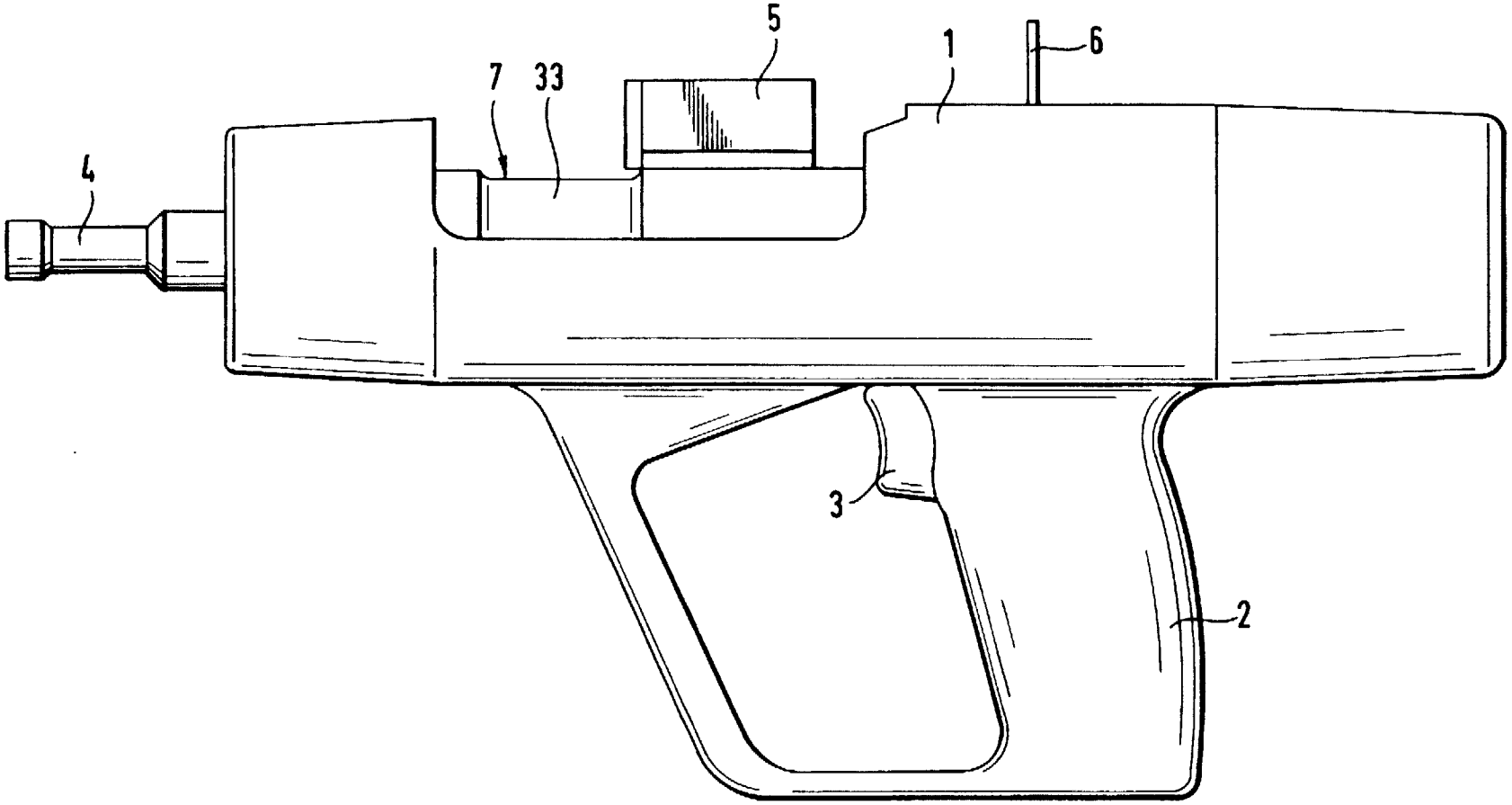
FIG. 1 is a side elevational view of an explosive powder charge operated setting tool embodying the present invention.

In FIG. 1 an explosive powder charge operated setting tool embodying the present invention is shown in a general view formed of a housing 1, and a housing part 7 with a receiving section 33 axially displaceable relative to the housing 1, a handle 2, a trigger-like activation switch 3 in the handle, a fastening element guide 4 located at the front end of the tool, that is the left hand end as viewed in FIG. 1, and a check valve 5 located in the receiving section 33. An explosive powder charge magazine 6 is shown extending upwardly from the upper part of the housing. The fastening element guide 4 serves to hold a fastening element and to guide it into a receiving material prior to and during the fastening element driving operation.

Figure 2:
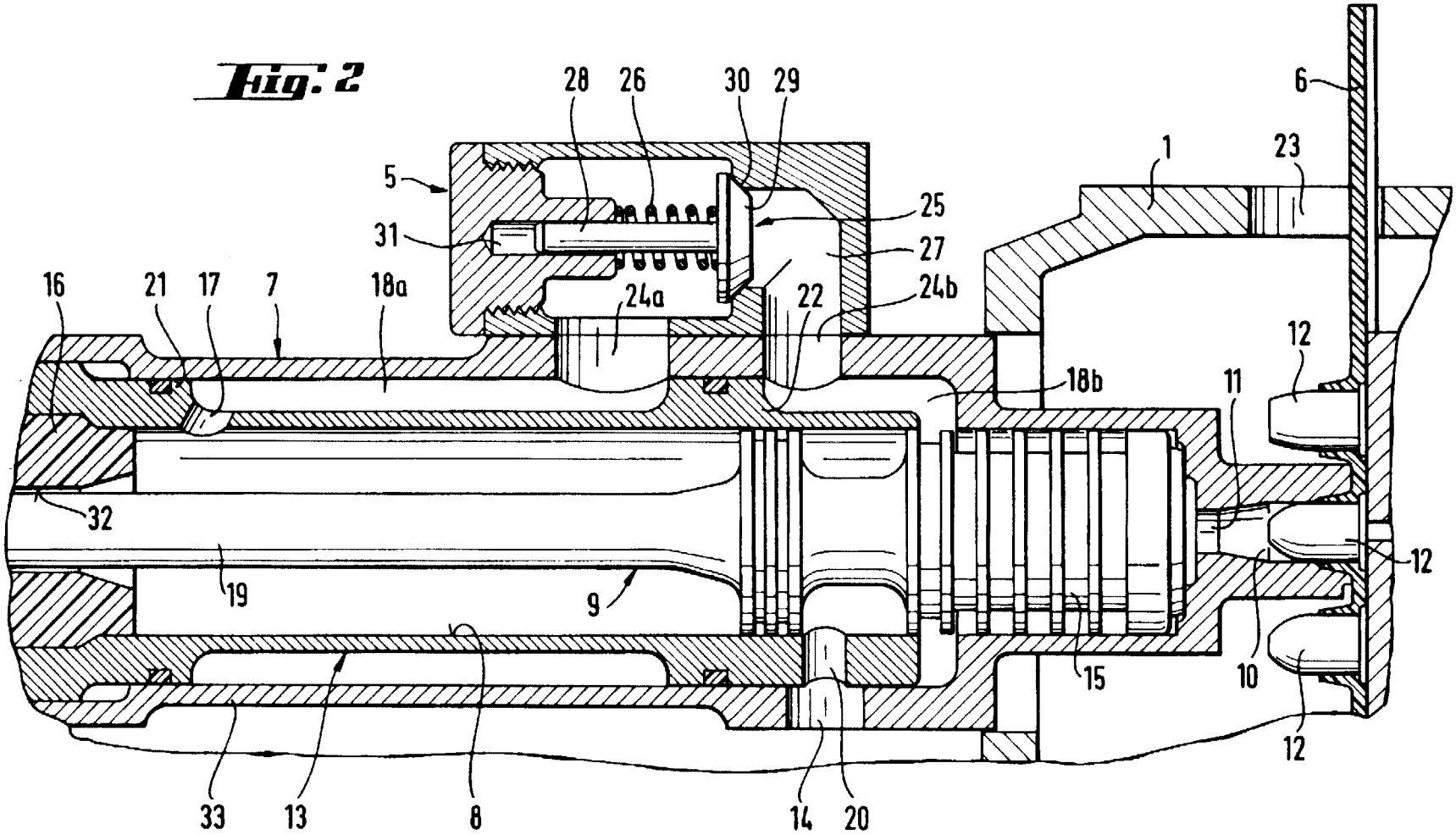
FIG. 2 is an enlarged partial view of the setting tool in FIG. 1 and shown in section.

FIG. 2 is an enlarged view of a portion of the setting tool shown in FIG. 1 before it is in position to drive a fastening element. During the driving operation the front end of the tool, that is, the element guide 4, is pressed against the surface of a receiving material. In FIG. 2 the axially extending and axially displaceable housing part 7 with a receiving section 33 projects axially in the driving direction from a front end of the housing 1.

An axially extending piston guide 13 forming a guide bore 8 for a driving piston 9 is located in the receiving section 33, and the driving piston 9 can be displaced from an initial rearward position, as shown, into a forward setting position by means of propelling gases generated when an explosive powder charge cartridge 12 is ignited. The piston guide 13 is axially fixed in the receiving section 33. In the rearward end region containing the cartridge 12, and forwardly of the cartridge an opening 14 is provided in the receiving section 33 aligned with a passage 20 in the piston guide 13. The opening 14 and the passage 20 are arranged coaxially and extend radially relative to the axial direction of the piston guide 13 and of the housing part 7. As a result, the guide bore 8 and the inside space of the housing part 7 adjacent to the cartridge 12 can be connected to the ambient atmosphere.

The rearward end of the housing part 7, relative to the driving direction, has a cartridge chamber 10 connected to the receiving section 33 of the housing part 7 by an axially extending bore 11. In the operating condition of the setting tool, the cartridge chamber 10 encloses an explosive powder charge cartridge 12 when the setting tool is pressed against a receiving material, not shown. The cartridge 12 is located in a strip shaped explosive powder charge magazine 6 and is movable in a guide channel 23 in the housing 1, with the channel extending perpendicularly to the driving direction of the tool or the axial direction of the housing part 7. The axial displacement of the housing part 7 relative to the housing 1 amounts at least to the length of the cartridge 12 measured in the driving direction or in the axial direction of the housing part 7.

In the driving direction between the cartridge chamber 10 and the opening 14, the housing part has a reduced inside diameter corresponding to the diameter of the cross-section of the sealing piston 15 of the driving piston 9 and corresponds also to the diameter of the guide bore 8 within the piston guide 13.

A channel **18*a*, 18*b* is formed between the outside surface of the piston guide 13 and the inside surface of the receiving section 33 of the housing part 7 and the forward part of the channel is in communication with the guide bore 8 through an opening 17 in the piston guide 13. The piston guide 13 has two radially outwardly extending guide regions 21, 22 each bearing against an inside wall surface of the receiving section 33. Between the two guide regions 21, 22 the piston guide 13 has a small wall thickness between the guide regions 21, 22, and in the region extending rearwardly from the guide region 22, whereby two circumferentially extending open spaces or sections result on the outside of the piston guide forming the channel 18*a*, 18*b* and such open sections are separated from one another by the rearward guide region 22**.

Each of the two sections of the channel **18*a*, 18*b* has a passageway 24*a*, 24*b* extending parallel to one another and running radially to the axial direction of the piston guide 13 and the passageways 24*a*, 24*b* each communicate with a check valve 5 positioned on the outside of the receiving section 33 of the housing part 7. A flow channel 27 is located in the check valve 5 and is U-shaped and connects the two sections of the channel 18*a*, 18*b* with one another. Within the check valve 5 the flow channel 27 has a larger cross-section on the side communicating with the channel section 18*a* rather than on the side communicating with the channel section 18*b*. Due to this difference, an annular shoulder 30 is formed within the check valve 5 and cooperates with a sealing conical surface 29 of a piston 25**.

The piston 25 can be moved perpendicularly to the axis of the passageways **24*a*, 24*b* and is pressed into a closed position, as shown in FIG. 2, against the shoulder 30 by a spring 26. A receiving bore 31 in the check valve 5 holds an axially extending shank 28 of the piston 29** and guides it so that it is axially displaceable.

An elastic damping element 16 is located in the forward end region of the piston guide 13 and dampens the velocity of the driving piston 9 if it is accelerated by excessive energy. An axially extending guide opening 32 for the damping element 16 has a diameter matched to the diameter of a cylindrical shank 19 of the driving piston 9.

While specific embodiments of the invention have been shown and described in detail to illustrate the inventive principles, it will be understood that the invention may be embodied otherwise without departing from such principles.

What is claimed is:

1. An explosive powder charge operated setting tool comprises a housing (1), an axially extending housing part (7) axially displaceable in and relative to said housing (1) and forming an axially extending receiving section (33) supporting an axially extending piston guide (13) forming an axially extending guide bore (8) for an axially extending driving piston (9) mounted therein, said piston guide (13) being axially fixed in said receiving section, said driving piston (9) being axially displaceable in a driving direction within said guide bore (8) from an initial rearward position into a forward setting position, a cartridge chamber (10) located in said housing part (7) rearwardly of the initial rearward position of said driving piston, said cartridge chamber (10) arranged to receive an explosive powder charge cartridge (12) for producing propelling gases upon ignition thereof for propelling said driving piston from the initial rearward position to the forward setting position, said receiving section (33) spaced radially outwardly from said piston guide (13) and forming therebetween an axially extending channel (**18*a*, 18*b*), a first opening (17) in said piston guide (13) communicates between said channel (18*a*, 18*b*) and said guide bore (8) at a position forwardly of said initial rearward position of said driving piston, a second opening (14) in said receiving section (33) communicating with the ambient atmosphere, a valve arrangement (5) in said channel (18*a*, 18*b*) radially outwardly of said housing part (7) and forming a storage space closed to the ambient atmosphere and formed by said guide bore (8) and a first section (18*a*) of said channel (18*a*, 18*b*) closer to the forward setting position of said driving piston, said channel (18*a*, 18*b*) comprises a second section (18*b*) closer to said cartridge chamber (12) than said first section (18*a*), means (22) on said piston guide (13) cooperating with said housing part (7) separating said first and second sections (18*a*, 18*b*) within said guide channel (18*a*, 18*b*), said valve arrangement (5) has a flow channel (27) connecting said channel first and second sections (18*a*, 18*b*), said piston guide (13) comprising a passage (20) communicating with said second opening (14) and closeable by said driving piston (9**) in the initial rearward position, and said valve arrangement (5) comprising a check valve (5) in said flow channel (27) and disposed in a closed position by propelling gases located in said storage space.

2. An explosive powder charge operated setting tool, as set forth in claim 1, wherein said check valve (5) can be displaced from a closed position into an open position by overcoming a force of a spring (26) located therein by propelling gases flowing from said cartridge chamber (10).

3. An explosive powder charge operated setting tool, as set forth in claim 1 or 2, wherein said check valve (5) is positioned in a region of said receiving section (33) in said housing part (7) laterally enclosing said piston guide (13).

* * * * *